US012371766B2

(12) United States Patent
Wiklund et al.

(10) Patent No.: US 12,371,766 B2
(45) Date of Patent: Jul. 29, 2025

(54) MARTENSITIC STAINLESS ALLOY

(71) Applicant: ALLEIMA STRIPTECH AB, Sandviken (SE)

(72) Inventors: Sara Wiklund, Gävle (SE); Jonas Nilsson, Järbo (SE); Sven-Inge Mattsson, Sandviken (SE); Anders Hoel, Gävle (SE); Guocai Chai, Sandviken (SE)

(73) Assignee: Alleima StripTech AB, Sandviken (SE)

( * ) Notice: Subject to any disclaimer, the term of this patent is extended or adjusted under 35 U.S.C. 154(b) by 664 days.

(21) Appl. No.: 17/614,709

(22) PCT Filed: Jun. 4, 2020

(86) PCT No.: PCT/EP2020/065508
§ 371 (c)(1),
(2) Date: Nov. 29, 2021

(87) PCT Pub. No.: WO2020/245285
PCT Pub. Date: Dec. 10, 2020

(65) Prior Publication Data

US 2022/0235444 A1 Jul. 28, 2022

(30) Foreign Application Priority Data

Jun. 5, 2019 (EP) ..... 19178590
Sep. 16, 2019 (CN) ..... 201910870222.1

(51) Int. Cl.
*C22C 38/46* (2006.01)
*C21D 6/00* (2006.01)
(Continued)

(52) U.S. Cl.
CPC ..... *C22C 38/46* (2013.01); *C21D 6/004* (2013.01); *C21D 6/005* (2013.01); *C21D 6/008* (2013.01);
(Continued)

(58) Field of Classification Search
CPC ... C21D 1/18; C21D 1/25; C21D 1/26; C21D 2211/004; C21D 2211/008;
(Continued)

(56) References Cited

U.S. PATENT DOCUMENTS 9,890,436 B2 2/2018 Millward et al.
10,196,718 B2 2/2019 Fukuzawa et al.
(Continued)

FOREIGN PATENT DOCUMENTS

CN 101158011 A 4/2008
CN 105525226 A 4/2016
(Continued)

OTHER PUBLICATIONS

International Search Report and Written Opinion dated Jul. 23, 2020, issued in corresponding International Patent Application No. PCT/EP2020/065508.
(Continued)

*Primary Examiner* — Nicholas A Wang
(74) *Attorney, Agent, or Firm* — Morgan, Lewis & Bockius LLP

(57) ABSTRACT

A martensitic stainless alloy comprising, in percent by weight (wt. %) C >0.50 to 0.60; Si 0.10 to 0.60, Mn 0.40 to 0.80; Cr 13.50 to 14.50; Ni 0 to 1.20; Mo 0.80 to 2.50; N 0.050 to 0.12; Cu 0.10 to 1.50; V max 0.10; S max 0.03; P max 0.03; the balance being Fe an unavoidable impurities.

23 Claims, 2 Drawing Sheets

Figure 1:
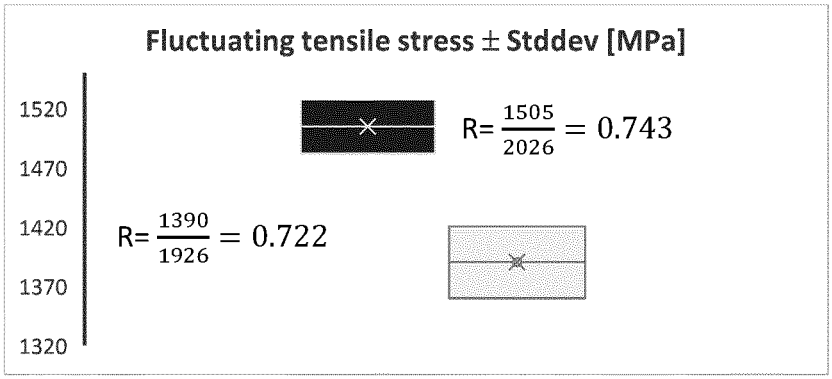

(51) Int. Cl.

| | |
|---|---|
| ***C21D 8/02*** | (2006.01) |
| ***C21D 9/52*** | (2006.01) |
| ***C22C 38/00*** | (2006.01) |
| ***C22C 38/02*** | (2006.01) |
| ***C22C 38/04*** | (2006.01) |
| ***C22C 38/20*** | (2006.01) |
| ***C22C 38/44*** | (2006.01) |

(52) U.S. Cl.
CPC ..... *C21D 8/0205* (2013.01); *C21D 8/0226* (2013.01); *C21D 8/0236* (2013.01); *C21D 8/0263* (2013.01); *C21D 9/52* (2013.01); *C22C 38/001* (2013.01); *C22C 38/002* (2013.01); *C22C 38/02* (2013.01); *C22C 38/04* (2013.01); *C22C 38/20* (2013.01); *C22C 38/44* (2013.01); *C21D 2211/008* (2013.01)

(58) Field of Classification Search
CPC .... C21D 2261/00; C21D 6/002; C21D 6/004; C21D 6/005; C21D 6/008; C21D 6/02; C21D 6/04; C21D 8/0205; C21D 8/021; C21D 8/0226; C21D 8/0236; C21D 8/0263; C21D 8/0268; C21D 8/0273; C21D 9/46; C21D 9/52
See application file for complete search history.

(56) References Cited

U.S. PATENT DOCUMENTS

| | | | | |
|---|---|---|---|---|
| 2008/0089804 | A1 | 4/2008 | Ishikawa et al. | |
| 2009/0301615 | A1 | 12/2009 | Montagnon | |
| 2013/0092296 | A1* | 4/2013 | Qui ..... | C21D 6/02 164/57.1 |
| 2016/0362770 | A1* | 12/2016 | Fukuzawa ..... | C21D 6/04 |
| 2017/0327916 | A1 | 11/2017 | Lee et al. | |

FOREIGN PATENT DOCUMENTS

| | | | |
|---|---|---|---|
| CN | 105934530 | A | 9/2016 |
| CN | 107002211 | A | 8/2017 |
| CN | 108300945 | A | 7/2018 |
| CN | 109280862 | A | 1/2019 |
| EP | 1918408 | A2 | 5/2008 |
| EP | 3031942 | A1 | 6/2016 |
| JP | H09-195016 | A | 7/1997 |
| JP | H11-61351 | A | 3/1999 |
| KR | 10-2013-0000841 | A | 1/2013 |
| KR | 10-2015-0074693 | A | 7/2015 |
| WO | 2005/093112 | A1 | 10/2005 |
| WO | 2019/070189 | A1 | 4/2019 |

OTHER PUBLICATIONS

Jing, "Control of Carbides in Special Steels", Metallurgical Industry Press, pp. 43-45, Jul. 2019.
English translation of Office Action dated Sep. 5, 2023, issued in corresponding Chinese Patent Application No. 202080041452.8.
Office Action dated Mar. 26, 2024, issued in corresponding Japanese Patent Application No. 2021-571522.
Shen Kaizhi, "Plastic Molding Molds", China Light Industry Press (2013) pp. 474-475.
Illustrated Shiny Star of Metal-Stainless Steel, Huo Lei, Jilin Publishing Group Co., Ltd. pp. 85-89, Apr. 30, 2012 (see CN OA previously submitted).
Communication pursuant to Rule 114(2) EPC dated Jun. 10, 2025, with 3rd Party Observation issued in corresponding European Patent Application No. 20729108.9.

* cited by examiner

MARTENSITIC STAINLESS ALLOY

TECHNICAL FIELD OF THE DISCLOSURE

The present disclosure relates to a martensitic stainless alloy, a stainless steel strip comprising the martensitic stainless alloy and different components made thereof.

BACKGROUND AND PRIOR ART

The martensitic stainless steels of today have in general high performance and good properties, such as high strength and high ductility making them suitable to use in different strip applications.

EP 3031942 discloses a martensitic stainless steel which may be used for flapper valves. However, this steel will not be suitable for use in demanding and high temperature applications as said steel will lose its mechanical strength due to its composition and manufacturing processes used. Hence, when used, this steel will not have the mechanical properties needed and additionally it will have a shorter service life.

Thus, there is a need for a martensitic stainless alloy having a combination of good mechanical properties and temperature stability, i.e. having and maintaining good mechanical properties in demanding applications and high temperatures (temperatures about 300° C.).

One of the aspects of the present disclosure is therefore to provide a solution to or reduce this problem.

SUMMARY

The present disclosure therefore relates to martensitic stainless alloy having the following composition in percent by weight (wt. %):

| | |
|---|---|
| C | >0.50 to 0.60; |
| Si | 0.10 to 0.60; |
| Cu | >0.4 to 1.50; |
| Mn | 0.40 to 0.80; |
| Cr | 13.50 to 14.50; |
| Ni | 0 to 1.20; |
| Mo | 0.80 to 2.50; |
| N | 0.050 to 0.12; |
| V | max 0.10; |
| S | max 0.03; |
| P | max 0.03; |

the balance being Fe and unavoidable impurities.

The present disclosure also relates to a component comprising or consisting of the martensitic stainless alloy. Additionally, the present disclosure also provides a process for manufacturing such a component.

The present invention is based on the finding that a component comprising a martensitic stainless alloy which has a carbon content of more than 0.50 (>0.50) to 0.60 wt. % will have an improved tensile strength and hardness in combination with high ductility and thereby have a better fatigue resistance. Additionally, it has been found that the composition of the martensitic stainless alloy as defined hereinabove or hereinafter will provide for a good temperature stability thereby the material will be excellent in high temperature applications. This finding is very surprising as generally this high carbon content (above 0.50 wt %) would result in both primary carbides and a carbide distribution of coarse carbide particles which will have a negative impact on the mechanical properties.

Furthermore, in the present martensitic stainless alloy as defined hereinabove or hereinafter, it has been found that the purposively addition of copper will improve the mechanical properties, such as the strength. Additionally, it has surprisingly been found that the addition of copper will also result in a reduction of A1 temperature. This will have a positive impact on the heat treatment as it will allow for a reduction of the temperatures used in annealing and during austenitization during hardening, which in turn is be beneficial from an energy efficiency and cost perspective.

Additionally, it has been found that the combination of the purposively added Cu and the high amount of carbon will provide for a high mechanical strength after heat treatment. Without being bound to any theory, it is believed that this is due to the effect of C increasing the strength of the martensite and the effect of Cu providing a solid solution strengthening effect in austenite and martensite and also giving a hardening effect through formation of clusters and precipitates. The obtained final product will thus have improved temperature stability because of the possibility to have a higher tempering temperature after quenching due to the high mechanical strength.

Furthermore, an object, such as a mechanical component or a strip, comprising or consisting of the martensitic stainless alloy as defined hereinabove or hereinafter will have a combination of improved fatigue strength and tensile strength, high hardness and good temperature stability in high temperature environments (temperatures about 300° C.) and an improved wear resistance.

DETAILED DESCRIPTION

The present disclosure relates to a martensitic stainless alloy comprising, in percent by weight (wt. %):

| | |
|---|---|
| C | >0.50 to 0.60; |
| Si | 0.10 to 0.60, |
| Mn | 0.40 to 0.80; |
| Cr | 13.50 to 14.50; |
| Ni | 0 to 1.20; |
| Mo | 0.80 to 2.50; |
| N | 0.050 to 0.12; |
| Cu | >0.4 to 1.50; |
| V | max 0.10; |
| S | max 0.03; |
| P | max 0.03; |

the balance being Fe and unavoidable impurities.

The present martensitic stainless alloy hereinafter also referred to as "the stainless alloy" or "the stainless steel", has a microstructure that after hardening and tempering comprises martensite, retained austenite, carbides and carbonitrides and copper precipitates. The microstructure of a hardened and tempered martensitic stainless alloy as defined hereinabove or hereinafter is further characterised by the presence of metal carbonitrides; $M_{23}C_6$ and $M_7C_3$ carbides; and/or carbides of other types, wherein M represents one or more metallic atoms.

The present stainless alloy will provide for an increase in hardness without having to compromise with the temperature stability compared to conventional martensitic stainless steels. High temperature stability is important as this means that the stainless alloy can be used in high temperature applications (about 300° C.).

A suitable hardening temperature for the present martensitic stainless alloy is to be found within the temperature range 980 to 1100° C., such as 1020 to 1060° C. A suitable tempering temperature may be found within the range 200 to 500° C., depending on application. By performing the tempering step in these temperatures, a component comprising or consisting of the present stainless alloy will become temperature stable at elevated temperatures (about 300° C.).

According to one embodiment, the present martensitic stainless steel may be tempered at temperatures of 400 to 450° C. The obtained material will have a hardness high enough to be used in the desired applications.

The hardening and tempering times may vary with the application and with the dimensions of the product. The hardening and tempering are performed in a furnace.

According to one embodiment, the present martensitic alloy comprises less than or equal to 0.5 wt. % unavoidable impurities, preferably less than or equal to 0.3 wt. % unavoidable impurities. The unavoidable impurities may occur naturally in the raw material or recycled material which is used to produce the stainless alloy. Examples of unavoidable impurities are elements and compounds which have not been added on purpose but cannot be fully avoided as they normally occur as impurities. The unavoidable impurities are thus present in the alloy at a concentration where they only have very limited impact on the final properties. Unavoidable impurities present in the stainless alloy may e.g. include one or more of Co, Sn, Ti, Nb, W, Zr, Ta, B, Ce and O.

Also, small amounts of alloying elements may be added during the production process, for example in the deoxidation step or to improve other properties. Examples, but not limited to, of such alloying elements are Al and Mg and Ca. Depending on which element is used, the skilled person will know how much is required. However, according to one embodiment these elements may be added to the stainless alloy ≤0.02 wt. %.

The alloying elements of the proposed martensitic stainless alloy are discussed below. However, their effects mentioned below should not be considered limiting Carbon (C)

C is an important element for the formation of metal carbonitrides; $M_{23}C_6$ and $M_7C_3$ carbides; and/or carbides of other types, wherein M represents one or more metallic atoms. C is also important for the hardenability of the steel. A too high content of C may however, in combination with other alloying elements, give rise to large and unwanted primary carbides formed during a primary production stage. Additionally, a high content of C makes the martensite more brittle and lowers the Ms-temperature, at which martensite starts to form, and may also increase the amount of retained austenite to too high levels. Thus, the maximum C content of the present alloy is 0.60 wt. %, such as 0.58 wt. %, such as 0.56 wt. %.

The high carbon content of the present alloy provided surprisingly a high particle density of carbides and also a high particle area fraction. Additionally, and surprisingly, the formed carbides were finely dispersed. The presence of smaller sizes and higher numbers of carbides will improve the mechanical properties.

This may have a positive impact on the wear resistance. The high carbon content is therefore >0.50, such as 0.51 wt. %, such as 0.52 wt. %, such as 0.53 wt. %.

The amount of C is in the present alloy limited to >0.50 to 0.60 wt. %, preferably 0.51 to 0.56 wt. %.

Copper (Cu)

In the present stainless alloy, Cu is purposely added. Cu is an austenite stabilizer and it has surprisingly been found that it, in the present steel, will contribute to the substitutional solid solution strengthening of the steel and thereby provide new possibilities to superior properties. Cu will also form a type of cluster and/or precipitates which will increase the strength.

The solubility of Cu in the matrix is more than 0.4 wt. % in equilibrium. In the present disclosure, the inventors have found that it is of importance to have an oversaturation of Cu in order to ensure a maximized solid solution strengthening of the phases martensite and retained austenite after hardening and tempering and furthermore the oversaturation will enable a cluster strengthening and also a precipitation hardening. Cu will also improve the corrosion resistance of the stainless alloy.

Hence, the content of Cu is more than 0.4 to 1.50 wt. %, such as 0.50 to 1.50 wt. % Cu, such as 0.55 to 1.30 wt. %.

Silicon (Si)

Si is a ferrite stabilizer and acts as a deoxidation agent. Si also increases the carbon activity and contributes to increasing the strength by solid solution strengthening. A too high content can result in formation of unwanted inclusions. The amount of Si is therefore limited to 0.10 to 0.60 wt. %, such as 0.20 to 0.55 wt. %, such as 0.30 to 0.50 wt. %.

Manganese (Mn)

Mn is an austenite stabilizer and acts as a deoxidation agent. Mn increases the solubility of N and improves the hot workability. A too high content can contribute to the formation of MnS inclusions in combination with S. The amount of Mn is therefore limited to 0.40 to 0.80 wt. %, such as 0.50 to 0.80 wt. %

Chromium (Cr)

Cr is essential for the corrosion resistance of the steel which is determined by the amount of Cr in the steel matrix. Cr forms carbides ($M_{23}C_6$, $M_7C_3$, carbonitrides) and increases the solubility of C and N. Cr is a ferrite stabilizer and a too high amount can result in the formation of delta ferrite. The amount of Cr is therefore limited to 13.50 to 14.50 wt. %.

Molybdenum (Mo)

Mo is a ferrite stabilizer and a strong carbide former. Mo has a positive effect on both the corrosion resistance and the hardenability of the steel. Mo also contributes to an improved ductility. Since Mo is an expensive element, the content should not be higher than necessary for economic reasons. The amount of Mo is therefore limited to 0.80 to 2.50 wt. %, preferably 0.80 to 2.00 wt. %, more preferably 0.90 to 1.30 wt. %.

Nitrogen (N)

N is an austenite stabilizer and increases the strength of the steel by interstitial solid solution strengthening. N contributes to an increased hardness of the martensite. N will form nitrides and carbonitrides. A too high amount of N will however decrease the hot workability. The amount of N is therefore limited to 0.050 to 0.12 wt. %, preferably 0.050 to 0.10 wt. %, such as 0.055 to 0.085 wt. %.

Nickel (Ni)

Ni is an austenite stabilizer and decreases the solubility of C and N. Since Ni is an expensive element, the content should be kept low for economic reasons and Ni is normally not purposively added in the present stainless alloy. The amount of Ni should be ≤1.20 wt. %, preferably 0.40 wt. %, and more preferably 0.35 wt. %. According to one embodiment, Ni is between 0.15 to 0.35 wt. %.

Vanadium (V)

V is a strong carbide former and restricts grain growth. As a carbide forming element, V may be present in the martensitic alloy and may be purposively added. It may also be present due to recycled material but then it is considered as an impurity. The content will also depend on the source of chromium. However, a too high content of V may reduce the ductility and hardenability and may result in unwanted primary carbides. If present in the stainless alloy, the amount of V is therefore limited to 0.010 to 0.10 wt. %, such as 0.030 to 0.10 wt. %.

Phosphorous (P)

P causes embrittlement. P is normally not added and should be limited to ≤0.03 wt. %.

Sulphur (S)

S will negatively affect the hot workability and a too high amount will cause the formation of MnS inclusions. S is normally not added and should be limited to ≤0.03 wt. %.

According to one embodiment, the present stainless alloy comprises any of the above-mentioned alloying elements in any of the ranges mentioned above. According to another embodiment, the present stainless alloy consists of any of the above-mentioned alloying elements in any of the ranges mentioned above.

Hence, the present alloy and objects composed of the same will have excellent strengthening because of maximized solid solution hardening due to the purposively added Cu in the ranges disclosed herein and because of the precipitation hardening with the finely divided carbides. Additionally, the ductility was improved by the composition of the microstructure.

The martensitic stainless alloy may suitably be produced in the form of a component, such as a strip, but it may also be produced in the form of a wire, rod, bar, tube etc.

The present martensitic stainless alloy may be used for different mechanical components, such as valve components for compressors, for examples as flapper valves. The present martensitic stainless steel is also suitable for other applications in which a high fatigue strength and/or wear resistance and edge performance is desirable.

According to one embodiment, the present stainless alloy may be produced accordingly:

Melting—The melting process may be conducted by use of EAF—electric arc furnace—which may be followed by an AOD process and optionally final adjustments;

Casting—Casting to a bloom of a desired shape, for example 100 to 600 mm;

Heating—Heating of the bloom until the material reaches a temperature of 1200 to 1350° C.;

Rolling—Hot rolling of the bloom to a strip. The hot rolling may be performed several passes depending on which roll mill is being used. In this step optionally one or more heat treatment step could be performed if found necessary in order to obtain the desired strip dimension.

Coiling—Coiling the strip, the coiling temperature after cooling is about 500 to 800° C.

Annealing—Annealing of the hot rolled strip at 700-900° C. for at least 1 h.

Optionally surface treatment

Rolling—Cold rolling to final thicknesses of for example 0.040-3 mm.

Optionally annealing—intermediate annealing at temperatures around 650-800° C. may be needed for recrystallization.

Hardening—Hardening may be conducted in a continuous hardening line with the following steps: austenitization, quenching, additional cooling, tempering, cooling to room temperature and polishing. The speed of hardening line is depending on the thickness of the material or mass flow and the size of the furnace(s) and could be between 100 and 1000 m/h. The length of the austenitization furnace and tempering furnace is about the same.

Austenitization temperatures are between 950 and 1100° C.

Quenching should be conducted in such way that the material temperature rapidly, typically within 2 minutes, comes below ~500° C. in order to avoid brittleness or reduced corrosion resistance.

Additional cooling is optionally conducted in order to pass the material below the Ms temperature and to obtain the desired level of retained austenite. The cooling temperature could be from to −100 to 100° C. depending on final application, although room temperature is normally applied.

Tempering could be set to 250 to 500° C. depending on the aimed final tensile strength.

The present disclosure is further illustrated by the following non-limiting examples.

EXAMPLES

Example 1

A number of alloys were produced by melting using a vacuum induction melting furnace (VIM). The elemental compositions of the alloys in wt. % are listed in Table I. The balance is Fe and unavoidable impurities. When no value is given for a specific element, the amount of that element is below the detection limit.

The alloys 1, 2 and 3 are included as comparative examples, while as the remaining alloys represent different embodiments of the stainless alloy according to the present disclosure. The alloys were produced as described below, stainless alloy.

TABLE I

The produced heats. Heats 1, 2 and 3 marked with a "*" are comparative examples. The balance of all heats is Fe and unavoidable impurities.

| | Composition | | | | | | | | | |
|---|---|---|---|---|---|---|---|---|---|---|
| | C | Si | Mn | S | Cr | Ni | N | Mo | Cu | V |
| 1* | 0.52 | 0.37 | 0.66 | 0.0013 | 13.72 | 0.32 | 0.072 | 1.01 | 0.03 | 0.04 |
| 2* | 0.50 | 0.42 | 0.71 | 0.0012 | 13.98 | 0.31 | 0.079 | 1.01 | 0.72 | 0.03 |
| 3* | 0.50 | 0.42 | 0.71 | 0.0012 | 13.98 | 0.31 | 0.061 | 1.01 | 0.04 | 0.03 |
| 4 | 0.55 | 0.37 | 0.67 | 0.0009 | 14.02 | 0.31 | 0.065 | 1.01 | 0.44 | 0.03 |
| 5 | 0.56 | 0.39 | 0.67 | 0.0013 | 13.97 | 0.31 | 0.073 | 1.01 | 0.60 | 0.03 |
| 6 | 0.53 | 0.40 | 0.67 | 0.0014 | 14.05 | 0.31 | 0.078 | 1.01 | 0.70 | 0.03 |

TABLE I-continued

The produced heats. Heats 1, 2 and 3 marked with a "*" are comparative examples. The balance of all heats is Fe and unavoidable impurities.

| | Composition | | | | | | | | | |
|---|---|---|---|---|---|---|---|---|---|---|
| | C | Si | Mn | S | Cr | Ni | N | Mo | Cu | V |
| 7 | 0.53 | 0.41 | 0.69 | 0.001 | 14.11 | 0.31 | 0.069 | 1.01 | 0.81 | 0.03 |
| 8 | 0.55 | 0.39 | 0.66 | 0.001 | 13.88 | 0.3 | 0.071 | 1.01 | 1.21 | 0.03 |
| 9 | 0.56 | 0.41 | 0.69 | 0.001 | 13.90 | 0.31 | 0.066 | 1.01 | 0.70 | 0.09 |
| 10 | 0.51 | 0.40 | 0.68 | 0.0013 | 13.97 | 0.31 | 0.064 | 1.22 | 0.71 | 0.09 |

From the heats, samples in the form of cylindrical test rods were produced for testing.

The process flow was accordingly;

melting of raw material in a vacuum induction melting furnace (VIM), casting, heat treatment with preheating 700° C. (30 min) followed by 1150° C. (30 min) prior to hot working, annealing (825 to 875° C. for 6 h) and machining of samples;

followed by hardening and tempering.

The test samples were hardened at 1030° C. and 1050° C. followed by quenching (to RT) and then tempering was performed at 450° C. (for hardening at 1050° C.) and 250 and 450° C. (for hardening at 1030° C.) for 2 h, the results can be seen in Table IIA and Table IIB.

These hardness (HV1) measurements were conducted according to SS-EN ISO 6507. The values are average values of 5 measurements.

TABLE IIA

Hardness (HV1) measurements. The values are average values of 5 measurements.

| | 1030 HV Av of 5 meas | |
|---|---|---|
| Alloy | 1030 - 250° C. | 1030 - 450° C. |
| 1* | 589 | 597 |
| 2* | 584 | 610 |
| 3* | 589 | 600 |
| 4 | 596 | 615 |
| 5 | 594 | 628 |
| 6 | 594 | 625 |
| 7 | 586 | 617 |
| 8 | 589 | 623 |
| 9 | 590 | 617 |
| 10 | 591 | 617 |

As can be seen from Table IIA, the results showed an increased hardness for the two sets of data hardened at 1030° C. The data showed a clear increase in hardness even though the tempering temperature is high and that there is an increase in hardness due to the addition of Cu.

Table IIA further shows that tempering at the higher temperature, 450° C., rendered a higher hardness (and thereby a higher tensile strength) for the inventive alloys. This means that the inventive alloys will have higher performance when used in high temperature applications.

TABLE IIB

| | 1050 HV Av of 5 meas |
|---|---|
| Alloy | 450° |
| 1* | 587 |
| 2* | 592 |
| 3* | 590 |
| 4 | 600 |
| 5 | 622 |
| 6 | 623 |
| 7 | 628 |
| 8 | 638 |
| 9 | 619 |
| 10 | 620 |

Table IIB shows that the hardness of the inventive alloys is higher than the comparative alloys at 1050 HV, 450° C. This implies that the inventive alloys will be suitable to use in high temperature applications as they will retain their higher performance.

Fatigue measurements

| Alloy 11: | | | | | | | | | | |
|---|---|---|---|---|---|---|---|---|---|---|
| | C | Si | Mn | S | Cr | Ni | N | Mo | Cu | V |
| 11 | 0.53 | 0.38 | 0.70 | <0.0005 | 14.07 | 0.17 | 0.062 | 0.93 | 0.71 | 0.048 |

Balance Fe and unavoidable impurities

In order to measure the fatigue properties an alloy, Alloy 11 was produced and had a composition as above and had a final thickness of 0.305 mm and was then tested for fatigue properties by means of staircase method utilizing a fluctuating tensile test machine AMSLER with 10% preload operating at resonance at ~80 Hz. The run out for the testing is defined as $5*10^6$ cycles. Several samples were produced and the samples consisted of a waist of 10 mm and a length of 15 mm. The method means that the complete cross section is exposed to the applied stress conditions and thereby the material properties are tested onto a larger volume for the limiting factor. The samples are tumbled to ensure a proper edge and high surface residual stresses. The probability to failure for the conducted fatigue testing is 50%.

In FIG. 1, the result of the fatigue test results is shown. The relation R expresses the ratio between fatigue limit and tensile strength. The obtained standard deviation is indicated by the size of each box, respectively. As can be seen from the figure, the inventive material exhibited a fatigue limit of 1505 MPa while the reference material (according to EN 1.4031) exhibit 1390.

Precipitates

TABLE III

The compositions of the alloys used for measuring carbide. Alloy A is within the present disclosure. Alloy A (As produced HV1 593), B (As produced HV1 520) and C (As produced HV1 552) and D (As produced HV1 612) are comparative alloys.

| Alloy | C | Si | Mn | S | P | Cr | Mo | Cu |
|---|---|---|---|---|---|---|---|---|
| Alloy D | 0.38 | 0.40 | 0.33 | <0.010 | <0.025 | 13.5 | 1.0 | — |
| Alloy C | 0.38 | 0.40 | 0.33 | <0.010 | <0.025 | 13.5 | 1.0 | — |
| Alloy B | 0.38 | 0.40 | 0.33 | <0.010 | <0.025 | 13.5 | 1.0 | — |
| Alloy A | 0.53 | 0.40 | 0.68 | <0.010 | <0.025 | 14.0 | 1.0 | 0.70 |

TABLE IV

Measurements of carbide distribution

| Alloy | Particle density No/100 $\mu m^2$ | Particle area fraction % | Max particle diameter μm | Volume fraction above 0.70 μm % |
|---|---|---|---|---|
| Alloy A1 | 56 | 5.0 | 1.07 | 15 |
| Alloy A2 | 58 | 4.1 | 0.97 | 6 |
| Alloy B | 32 | 2.6 | 1.36 | 21 |
| Alloy C | 30 | 3.7 | 1.30 | 48 |

As can be seen from the present table, the alloys of the present disclosure have a particle density above 50.

TABLE V

Investigation of Cu-particles.

| Method | No of particles | Average Area [$\mu m^2$] | Average Diameter [μm] | Inspected area [$\mu m^2$] | Particles/ 100 $\mu m^2$ |
|---|---|---|---|---|---|
| Image processing | 92 | 0.012 | 0.12 | 1370 | 7 |

Figure 3:
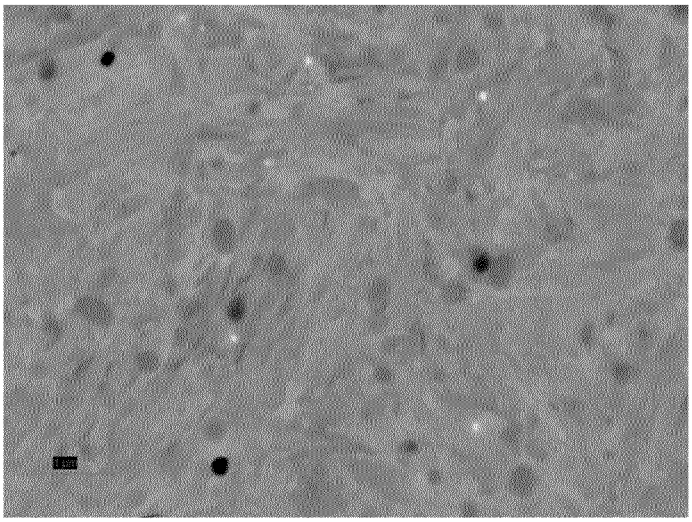

The data of Table V have been obtained from image processed SEM images. An example thereof is given in FIG. 3. The Cu particles of the present alloy are, according to Thermo Calc calculations, stable at temperatures below the A1 temperature. The presence of Cu particles in the image indicates that besides the maximized solid solution, also non-visible Cu clusters and non-visible finer Cu particles will be present. Both the Cu precipitates and the Cu clusters will contribute to the mechanical properties.

The thermal stabilities of some of the alloys of Table III have been evaluated. The results are shown in FIG. 2.

Figure 2:
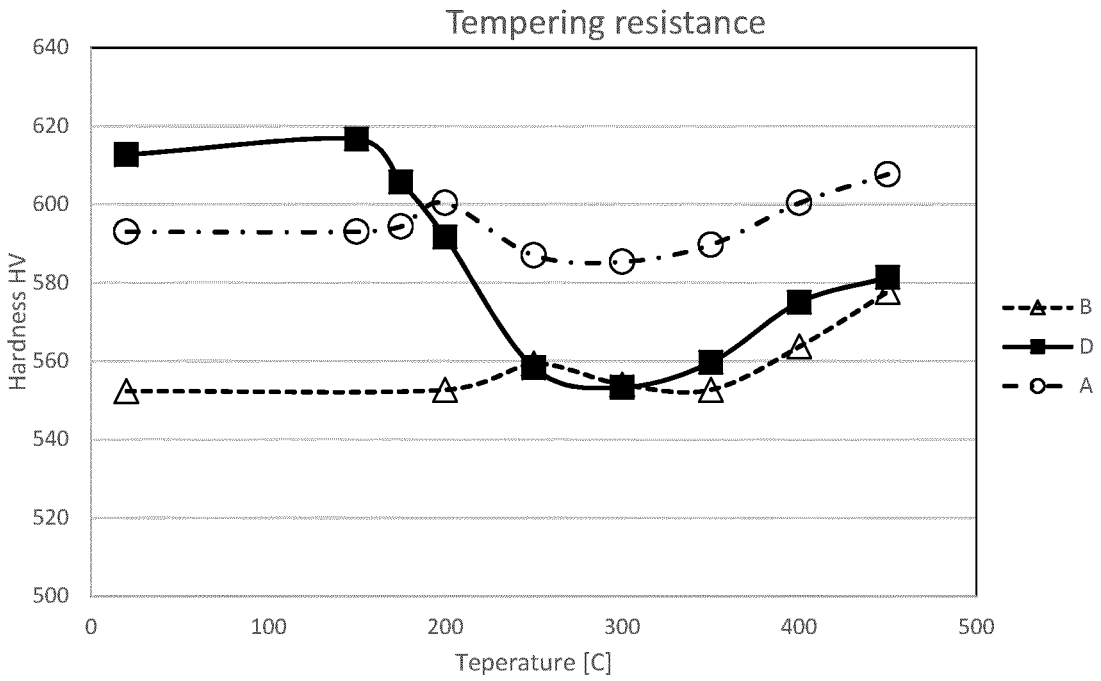

FIG. 2 shows that alloy D will lose their properties if exposed to a higher temperature then what is being stabilized during tempering. For alloy A, a higher hardness and thereby higher tensile strength is obtained without compromising on the thermal stability which is shown as the hardness is almost unaffected throughout the temperature range.

The invention claimed is:

1. A martensitic stainless alloy comprising, in percent by weight (wt. %):

| | |
|---|---|
| C | >0.50 to 0.60; |
| Si | 0.10 to 0.60, |
| Mn | 0.40 to 0.80; |
| Cr | 13.50 to 14.50; |
| Ni | 0 to 1.20; |
| Mo | 0.80 to 2.50; |
| N | 0.050 to 0.12; |
| Cu | more than 0.4 to 1.50; |
| V | max 0.10; |
| S | max 0.03; |
| P | max 0.03; |

the balance being Fe and unavoidable impurities, wherein a microstructure of the martensitic stainless alloy includes a plurality of particles selected from the group consisting of metal carbonitrides; $M_{23}C_6$ and $M_7C_3$ carbides; and carbides of other types, where M represents one or more metallic atoms, and wherein a particle density of the plurality of particles is 56-58 per 100 $\mu m^2$, a particle area fraction is 4.1 to 5.0%, a max particle diameter is 1.07 μm, and a volume fraction of particles having a diameter above 0.70 μm is 6-15%.

2. The martensitic stainless alloy according to claim 1, wherein the content of Si is 0.20 to 0.55 wt. %.

3. The martensitic stainless alloy according to claim 1, wherein the content of Mn is 0.50 to 0.80 wt. %.

4. The martensitic stainless alloy according to claim 1, wherein the content of Mo is 0.90 to 1.30 wt. %.

5. The martensitic stainless alloy according to claim 1, wherein the Ni content is <0.80 wt. %.

6. The martensitic stainless alloy according to claim 1, wherein the N content is 0.050 to 0.10 wt. %.

7. The martensitic stainless alloy according to claim 1, wherein the V content is 0.030-0.10 wt. %.

8. The martensitic stainless alloy according to claim 1, wherein the C content is 0.51-0.60 wt. %.

9. The martensitic stainless alloy according s claim 1, wherein the stainless alloy comprises 0.50-1.5 wt. % Cu.

10. The martensitic stainless alloy according to claim 1, wherein the microstructure includes Cu precipitates.

11. The martensitic stainless alloy according to claim 1, wherein:

Si is 0.20 to 0.55 wt. %,
Mn is 0.50 to 0.80 wt. %,
Mo is 0.80 to 2.00 wt. %,
Ni is <0.80 wt. %,
N is 0.050 to 0.10 wt. %,
V is 0.030 to 0.10 wt. %,
C is 0.51 to 0.60 wt. %, and
Cu is 0.50 to 1.5 wt. %.

12. The martensitic stainless alloy according to claim 11, wherein the content of Mo is 0.90 to 1.30 wt. %.

13. An object comprising the martensitic stainless alloy according to claim 12.

14. The martensitic stainless alloy according to claim 10, wherein the Cu precipitates have an average area of 0.012 $\mu m^2$ and an average diameter of 0.12 μm, and wherein a particle density of the Cu precipitates is 7 per 100 $\mu m^2$.

15. The martensitic stainless alloy according to claim 1, wherein the martensitic stainless alloy has a fatigue limit of 1505 MPa.

16. The martensitic stainless alloy according to claim 1, wherein the metallic atoms include Cr and Mo.

17. A stainless steel object comprising the martensitic stainless alloy according to claim 1.

18. The stainless steel object according to claim 17, wherein the object is a strip.

19. The stainless steel object according to claim 18, wherein said object is cold rolled, hardened and tempered.

20. The stainless steel object according to claim 19, wherein said object is cold rolled to final thicknesses of 0.040 to 3 mm.

21. A flapper valve for a compressor, comprising:

a flapper valve body formed of a martensitic stainless alloy, the martensitic stainless alloy having a composition including, in percent by weight (wt. %):

C >0.50 to 0.60;
Si 0.10 to 0.60;
Mn 0.40 to 0.80;
Cr 13.50 to 14.50;
Ni 0 to 1.20;
Cu more than 0.4 to 1.50;
V max 0.10;
S max 0.03;
P max 0.03;
the balance being Fe and unavoidable impurities, wherein a microstructure of the martensitic stainless alloy includes a plurality of particles selected from the group consisting of metal carbonitrides; $M_{23}C_6$ and $M_7C_3$ carbides; and carbides of other types, where M represents one or more metallic atoms, and wherein a particle density of the plurality of particles is 56-58 per 100 $\mu m^2$, a particle area fraction is 4.1 to 5.0%, a max particle diameter is 1.07 μm, and a volume fraction of particles having a diameter above 0.70 μm is 6-15%.

22. The flapper valve according to claim 21, wherein the martensitic stainless alloy has a fatigue limit of 1481 to 1527 MPa.

23. The flapper valve according to claim 21, wherein the composition includes, in percent by weight (wt. %):

C 0.51 to 0.56;
Si 0.30 to 0.50;
Mn 0.60 to 0.80;
Cr 13.50 to 14.50;
Ni 0 to 0.80;
Mo 0.90 to 1.30;
N 0.050 to 0.090;
Cu more than 0.4 to 1.60;
V 0.030 to 0.10;
S max 0.03;
P max 0.03;
the balance being Fe and less than or equal to 0.5 wt. % unavoidable impurities.

* * * * *